United States Patent [19]

Fahrni et al.

[11] 4,109,611

[45] Aug. 29, 1978

[54] COATING DEVICE

[75] Inventors: Fritz Fahrni, Islikon; Anton Zimmermann, Montagny-la-Ville, both of Switzerland

[73] Assignee: Ciba-Geigy AG, Basel, Switzerland

[21] Appl. No.: 775,922

[22] Filed: Mar. 9, 1977

[30] Foreign Application Priority Data

Mar. 30, 1976 [CH] Switzerland ..... 3955/76

[51] Int. Cl.[2] ..... B05C 5/00

[52] U.S. Cl. ..... 118/325; 118/DIG. 4

[58] Field of Search ..... 118/324, 325, 24, DIG. 4; 427/420, 424

[56] References Cited

U.S. PATENT DOCUMENTS

| | | | |
|---|---|---|---|
| 3,508,947 | 4/1970 | Hughes | 118/324 X |
| 3,920,862 | 11/1975 | Damschroder et al. | 427/420 X |
| 3,973,062 | 8/1976 | Fahrni | 118/DIG. 4 |
| 4,019,906 | 4/1977 | Ridley | 118/DIG. 4 |

FOREIGN PATENT DOCUMENTS

| | | | |
|---|---|---|---|
| 97,789 | 4/1961 | Netherlands | 118/DIG. 4 |

*Primary Examiner*—John P. McIntosh
*Attorney, Agent, or Firm*—Wenderoth, Lind & Ponack

[57] ABSTRACT

A device for coating a travelling web of material such as photographic paper with a coating liquid includes a means for transporting the web along a path of travel and a coating hopper of the slot or slide type positioned above the path of travel and provided with a pouring lip from which the coating liquid falls freely as a liquid curtain onto the web to be coated. The pouring lip is provided with a rectilinear sharp edge at a distance of 0.7 to 2.5 mm from an imaginary vertical plane in the operative position of the hopper which is at a tangent to the pouring lip at that boundary surface which is on the coating liquid side. By virtue of this sharp edge a straight wetting line, and consequently a very even curtain thickness can be obtained. If the coating hopper is of the slide type whose slide surface is cylindrically curved in the area near the pouring lip the radius of curvature is preferably within the range between 20 and 40 mm, particularly between 25 and 35 mm. The minimum flow rate necessary for maintaining a stable liquid curtain is thereby considerably decreased.

10 Claims, 7 Drawing Figures

COATING DEVICE

BACKGROUND OF THE INVENTION

The invention relates to a coating device for coating a travelling web of material with a coating liquid comprising means for transporting the web along a path of travel and a coating hopper positioned above the path of travel and which extends substantially at right angles above it and is provided with a pouring lip, in particular a slide hopper with at least one slide surface for producing a liquid curtain which falls freely onto the web to be coated.

Cascade coating is one of the most efficient precision coating methods and is used in particular for producing photographic materials. Cascade coating methods and slide hoppers suitable therefor are described in more detail, inter alia, in U.S. Pat. Nos. 3,508,947 and 3,632,347.

Of the numerous known cascade coaters, two kinds chiefly are of particular importance, viz. slot hoppers and slide hoppers. In the slot hoppers, the coating liquid issues at the lower end of a metering slot situated substantially at right angles above the material to be coated and directly forms a free-falling curtain. In the slide hoppers on the other hand, the coating liquid is forced through a metering slot exiting into a downwardly inclined slide surface, then flows in a thin film down the slide surface under the force of gravity and only forms the free-falling curtain at the lower end of the slide surface when leaving this latter. In both hoppers, the liquid curtain can have one or more layers.

It will be appreciated that the prerequisite for a precise, even coating over the entire width of the surface to be coated is a correspondingly even thickness of the free-falling curtain. To satisfy this prerequisite, two essential requirements must be met: the exit or metering slot, which determines the thickness of the layer of liquid, must be so precisely constructed and dimensioned that the rate of flow of the liquid over the entire width to be coated is uniform.

The lip, i.e. the point where the free-falling curtain forms from the layer of liquid bounded on one or two sides, must be so formed that the passage of the flow of liquid is free from disturbance, in particular from lateral speed components.

The first requirement can be satisfied without any great difficulties by applying knowledge of the laws of hydrodynamics and by as precise a construction as possible of the hopper. In practice, however, considerable difficulties are encountered in satisfying the second requirement. For it becomes apparent that, during the transition from the flow of a layer bounded on one or two sides to the free unrestricted fall, disturbances which have their origin in a nonuniform, uneven wetting line can arise. Such wetting lines are necessarily formed wherever the liquid leaves the boundary wall on one or both sides and begins to form a free boundary surface with the atmosphere. If as a consequence of the geometrical formation of the pouring zone, i.e. the location where the free-falling curtain forms, the wetting line falls on a substantially even or relatively slightly curved surface, then in virtually every case an irregular, uneven wetting line is formed. The cause thereof lies in the impossibility of forming the surface of a solid material so evenly that a uniform wetting is ensured. Slight differences in roughness or traces of impurities result in locally uneven angles of wetting and thus in an irregularly curved wetting line. The unavoidable consequence thereof is an uneven initial thickness of the curtain, which, because of the strictly laminary flow, is transmitted over the entire curtain to the coating and appears there in the form of thicker or thinner longitudinal zones.

SUMMARY OF THE INVENTION

It has now been found that these difficulties can be surmounted by means of a coating device of the kind defined at the outset, and that the formation of a straight wetting line, and consequently an even curtain thickness, can be obtained in simple manner if, according to the invention, the pouring lip has a first sharp rectilinear edge with a radius of curvature not exceeding 0.1 mm, preferably not exceeding 0.05 mm, at a distance of 0.7 to 2.5 mm from an imaginary vertical plane which is at a tangent to a first boundary surface at the coating liquid side in the operative position of the hopper.

The formation and arrangement of the sharp rectilinear edge ensures that the coating composition is able to form the wetting line without substantial tensile or compression stress in the area of the edge. By choosing a narrower distance than the minimum one indicated, there is the danger that, on account of the hydrodynamic pressure which is formed in the area of the pouring lip, the liquid will try to disperse in such a way that it can surround the edge right up to the contiguous surface and again form there a curved wetting line. Vice versa, if the distance is too great, the liquid can contract in such a way that the wetting line retreats from the edge and once more becomes nonlinear.

What has been said hereinabove tacitly assumes that the free-falling liquid curtain is stable. However, certain requirements must be satisfied for forming or maintaining a stable liquid curtain. One of these requirements is that the coating liquid has a relatively high specific minimum rate of flow. This minimum rate of flow is dependent on the viscosity and surface tension of the liquid and to all intents and purposes cannot be less than approx. 0.5 ml per sec and per centimeter of curtain. The presence of sufficient amounts of suitable wetting agents is vital. The minimum rate of flow referred to above can only be attained under favourable viscosity and wetting agent conditions. Liquid curtains which are to remain stable also under conditions of actual practice, i.e. which do not break irreversibly under the influence of chance disturbances, require a substantially higher rate of flow than the minimum one referred to, for example twice as high or higher.

It will be understood that the requirement of a minimum rate of flow constitutes a considerable restriction of the applicability of the cascade coating method. For example, at the given speed at which the web to be coated travels, the above requirement imposes a lower limit on the thickness of the liquid coating produced, or the speed of the web has to be correspondingly increased in order to produce a thinner layer. This circumstance is of especial importance whenever — as usually happens — the coating has to be dried continuously. The requirement of the minimum rate of flow determines in this case the minimum efficiency of the drying apparatus. This requirement must be satisfied regardless of whether a thick coating is to be dried at low speed or a thin coating is to be dried at high speed. The endeavour in this connection is to manage with as low specific rates of flow as possible.

Surprisingly, it has now been found that, in those slide hoppers whose lower surface area which is transformed into a lip is cylindrically curved, this minimum rate of flow can be quite substantially reduced if, according to a further aspect of the invention, the radius of curvature of this slide surface area is approx. 20 to 40 mm, preferably approx. 25 to 35 mm. Advantageously, the slide surface/lip should terminate vertically. It has been established that both an increase and a reduction in the radius of curvature to above or below the indicated values raise the necessary specific rate of flow for a stable curtain. Vice versa, the most stable and disturbance-free curtain is obtained at a given rate of flow within the indicated limits of the radius of curvature.

BRIEF DESCRIPTION OF THE DRAWINGS

The invention is described hereinafter in greater detail with reference to the drawings.

DETAILED DESCRIPTION OF THE INVENTION

The particulars relating to position and direction, such as above, below, vertical and horizontal, refer to the operative position of the coating device.

Figure 1:
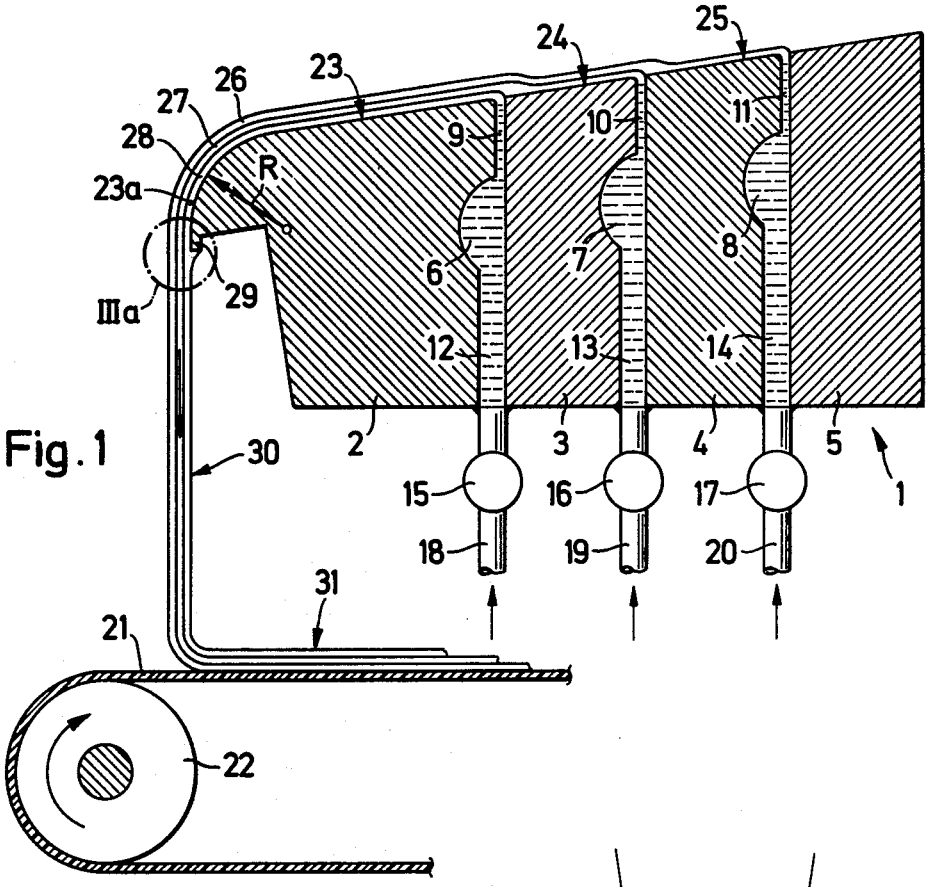
FIGS. 1 and 2 show simplified sectional representations to two coating devices of the invention.

Except for the shape of the pouring lip of the invention, the slide hopper illustrated in FIG. 1 has substantially the same form as, for example, the hoppers of this kind described in DT-OS No. 24 48 440.

The slide hopper designated in its entirety as 1, comprises four plates 2, 3, 4 and 5. The boundary surfaces between the individual plates are provided with indentations which form distributor ducts 6, 7 and 8 which extend substantially over the entire width of the slide hopper (vertically to the plane of projection), metering slots 9, 10 and 11 which also extend over the width of the hopper and are connected to the distributor ducts over their entire length, and lines 12, 13 and 14 which extend into the distributor ducts. Feed lines 18, 19 and 20, each of which is provided with a flow meter 15, 16 and 17 respectively, are connected to these lines.

Below the hopper 1, the web 21 to be coated is moved along in the direction of the arrow approximately horizontally by transportation means of which, for simplicity's sake, only a carrier roller 22 is illustrated.

The upper boundary surfaces of the plates 2, 3 and 4 are inclined downwardly at an angle and form slide surfaces on which the coating compositions which are fed via the feed lines 18, 19 and 20 and issuing from the metering slots 9, 10 and 11 flow downwardly in the form of three superimposed thin layers 26, 27 and 28. The bottom slide surface 23 is cylindrically curved in its lower area 23*a* and vertically is transformed into a freely suspended pouring lip 29 from which the coating compositions fall freely in the form of a three-layered curtain 30 onto the web 21 to be coated and form thereon a three-layered coating.

Although this embodiment of the invention shows only one three-layered curtain, it will however be readily understood that the number of layers can be as large or as small as desired. Material to the invention, as will be explained hereinafter, is primarily the curvature of the slide surface 23 and the form of the pouring lip 29.

Figure 3A:
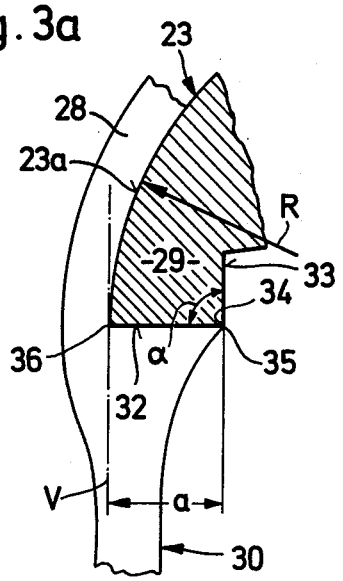
FIGS. 3*a–c* and 4 show enlarged details of FIGS. 1 and 2.

The lip is illustrated in greater detail in FIG. 3*a*. As can be seen, it is bounded on three sides, viz. by the bottom area 23*a* of the slide surface 23, by a horizontal lower surface 32 and by a vertical rear surface 33. Together with the lower surface 32, the rear surface 33 forms a recti-linear sharp edge 34 which extends in the direction of the axis of curvature of the slide surface 23, i.e. parallel to an imaginary vertical plane V which is at a tangent to the bottom area 23*a* of the slide surface 23.

By an appropriate dimensioning of the distance *a* of the edge 34 from the tangent plane V, the wetting line 35 of the curtain 30 is formed exactly at this edge 34. Since the uniformity of the thickness of the curtain and thus of the coating to be produced is decisively influenced by the linearity of the wetting line, the edge 34 must be very precise. In particular, its radius of curvature should not exceed 0.1 mm, preferably 0.05 mm. The angle $\alpha$, at which the two boundary surfaces of the pouring lip forming the edge coincide, is preferably in the range of approx. $90° \pm 30°$.

Figure 3B:
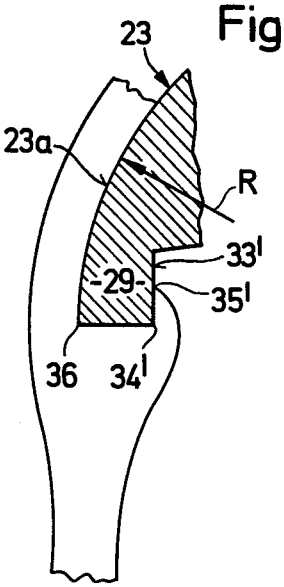
Figure 3C:
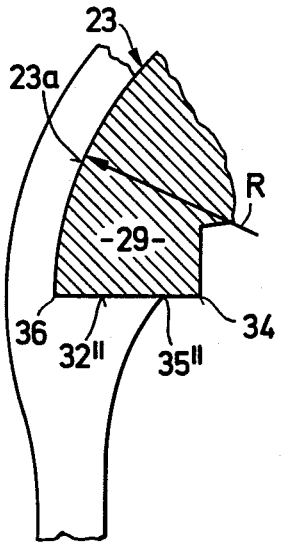

The distance *a* of the edge 34 from the tangent plane V is dependent on the specific rate of flow and the thickness of the curtain 30. Values of 0.7 to 2.5 mm, preferably of approx. 1 to 1.5 mm, at rates of flow in the range between approx. 0.5 and 3 ml/sec. cm, have proved to be the most suitable. It will be understood that smaller deviations are also possible. However, if the distance is markedly smaller than that referred to above, then the wetting line is formed on the rear surface of the pouring lip and becomes irregular. On the other hand, if the distance is too great the wetting line forms on the lower surface of the lip and also becomes irregular. These two occurrences are illustrated in FIGS. 3*b* and 3*c* respectively.

In the drawing, both boundary surfaces 32 and 33 of the lip 29 are shown as even. Although this construction has proved to be the best practice, it is nonetheless entirely possible to construct these surfaces for example cylindrically curved or the like. The important thing is solely that edge 34 be absolutely rectilinear and sharp. In the embodiment of the invention illustrated in the drawing, the bottom slide surface area 23 also forms with the lower surface 32 an edge 36. Although this construction is advantageous in actual practice, the slide surface could nonetheless also be transformed continuously into the lower surface. Provided that this transformation forms an edge, as in the drawing, it should however be ensured that the bottom slide surface area 29 is vertical at the latest at the edge 35, since this construction has proved particularly advantageous in fluid mechanics.

Figure 5:
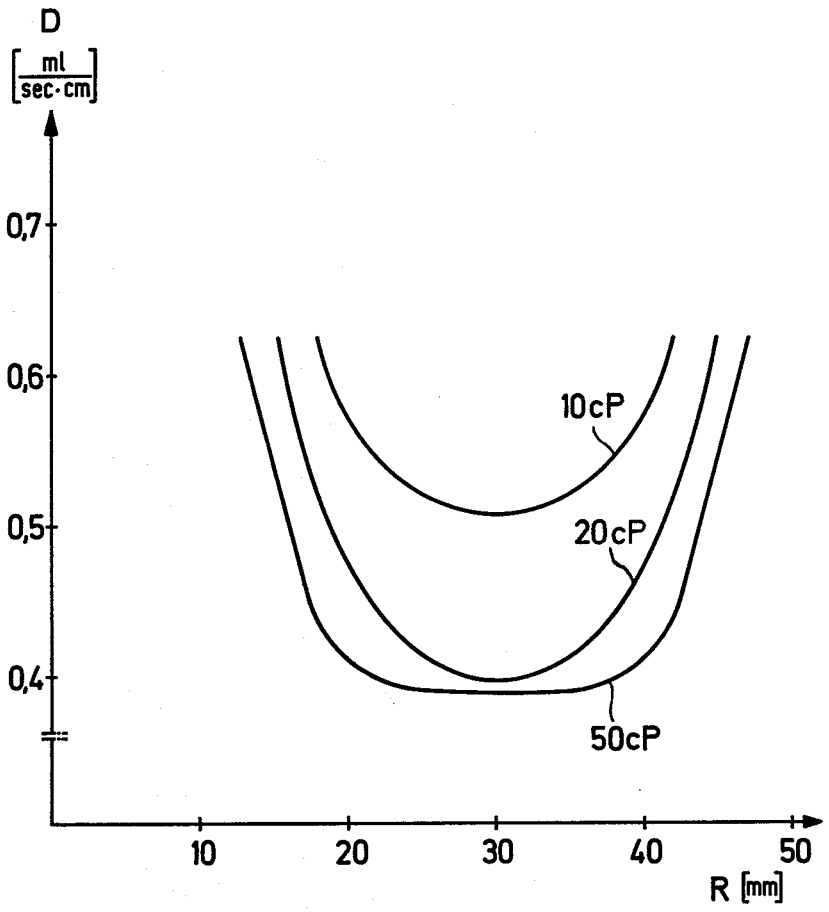
FIG. 5 shows a diagram of the relationship between the rate of flow D and the slide surface curvature R.

As has already been mentioned above, a certain minimum rate of flow (amount of liquid per unit of time and centimeter of curtain width) is necessary for the formation and maintainance of a stable liquid curtain. Surprisingly, it has now been found that this minimum rate of flow is very highly dependent on the geometrical form of the bottom slide surface 23, in particular on the radius of curvature R of its lower curved area 23*a*. As is clearly evident from the diagram illustrated in FIG. 5, which shows the relationship between the minimum rate of flow D and the radius of curvature R at different viscosities of the coating fluid, the minimum rate of flow is lowest at radii of curvature in the range between 25 mm and 35 mm, then increases at first relatively slowly with decreasing and increasing radii of curvature and then rapidly outside the radius range between 20 mm and 40 mm. Depending on the actual, radii of curvature between 20 mm and 40 mm, preferably between 25 mm and 35 mm, will be chosen in actual practice.

The special dimensioning of the slide surface curvature is naturally advantageous in connection with the special construction of the pouring lip. Nevertheless, cascade coating derives considerable advantages therefrom by itself alone and for this reason independent protection is also claimed for it.

Figure 2:
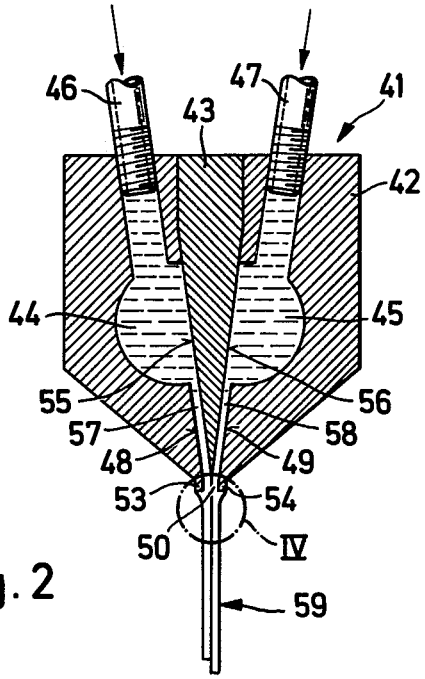

FIG. 2 illustrates another embodiment of a slide hopper according to the invention. For simplicity's sake, only the hopper designated in its entirety as 41 is shown. Except for the pouring lips having the form according to the invention, such a hopper belonging to the group of slot hoppers discussed at the outset is also described in the above mentioned DT-OS No. 24 48 440.

The hopper 41 consists of an elongated (vertically to the plane of projection) tray which is subdivided by a partition 43 into two chambers 44 and 45. Two feed lines 46 and 47 for two coating liquids extend into these chambers.

The bottoms of both chambers are converted in the centre into two surfaces 48 and 49 which are downwardly inclined at an angle and converge to form a V. In the bottom of the tray at their lowest extremity is a longitudinal slot 50 with the two boundary walls 51 and 52. On both sides of the outlet side of this slot 50 downwardly projecting pouring lips 53 and 54 are formed. The partition 43 also has two coinciding V-shaped lower sides 55 and 56 which together with the surfaces 48 and 49 form metering slots 57 and 58. The coating liquids issue through these slots as thin layers from the chambers 44 and 45 into the slot 50, where they are combined to form a double layer. This double layer then issues from the slot 50 and forms a free-falling liquid curtain at the pouring lips 53 and 54.

Figure 4:
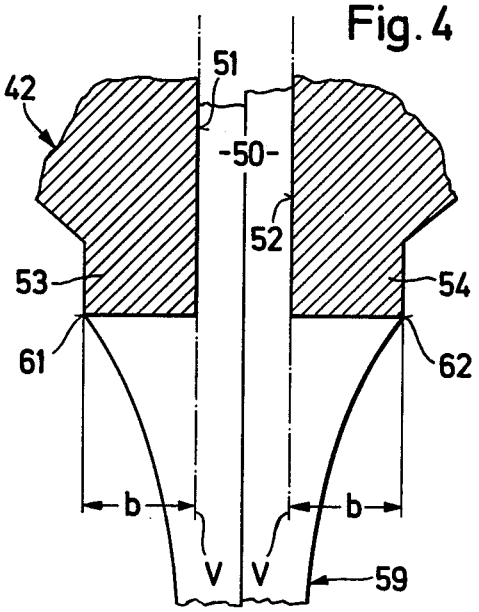

FIG. 4 shows a large scale view of the pouring lips. These lips are formed in exactly the same way as the lip 29 of the embodiment of FIG. 1. The distance *b* of the edges 61 and 62 from the vertical planes V is again also dependent on the thickness of the liquid curtain.

What is claimed is:

1. A device for coating a travelling web of material with a coating liquid, said device comprising:

means for transporting a web along a path of travel; and a coating hopper positioned above said path of travel and extending substantially at right angles thereto, said hopper including a pouring lip, said coating hopper having at least one slide surface for producing a liquid curtain which falls freely onto the web to be coated, said pouring lip having a first rectilinear sharp edge with a radius of curvature not exceeding 0.1 mm, said sharp edge being spaced by a distance of from 0.7 to 2.5 mm from an imaginary vertical plane which is tangent to a first boundary surface of said pouring lip, on the coating liquid side thereof, in the operative position of the hopper.

2. A device according to claim 1, wherein said radius of curvature does not exceed 0.05 mm.

3. A device according to claim 1, wherein said sharp edge is formed by second and third boundary surfaces of said pouring lip, said second and third boundary surfaces extending at an angle of approximately 60° to 120° to each other.

4. A device according to claim 3, wherein said second boundary surface is substantially planar and substantially horizontal.

5. A device according to claim 1, wherein said first boundary surface and said second boundary surface form a second edge and, said first boundary surface is substantially vertical in the area of said second edge.

6. A device according to claim 1, wherein said distance of said first sharp edge from said vertical tangent plane is 1 mm to 1.5 mm.

7. A device according to claim 1, wherein said slide surface is cylindrically curved at least in the area thereof close to said pouring lip with a radius of curvature of 20 to 40 mm.

8. A device according to claim 7, wherein said radius of curvature of said slide surface is 25 to 35 mm.

9. A device for coating a travelling web of material with a coating liquid, said device comprising:

means for transporting a web along a path of travel; and a coating hopper positioned above said path of travel and extending substantially at right angles thereto, said hopper including two pouring lips, said lips being adjacent to each other and between them form a metering slot from which the coating liquid can issue and is then able to form a free-falling curtain impinging on the web to be coated, each of said lips having a first rectilinear sharp edge with a radius of curvature not exceeding 0.1 mm, each said sharp edge being spaced by a distance of from 0.7 to 2.5 mm from a respective imaginary vertical plane which is tangent to a respective boundary surface of the respective pouring lip, on the coating liquid side thereof, in the operative position of the hopper.

10. A device according to claim 9, wherein said radius of curvature does not exceed 0.05 mm.

* * * * *